US011004433B1

(12) United States Patent
VanHaight

(10) Patent No.: US 11,004,433 B1
(45) Date of Patent: May 11, 2021

(54) TILTING STANDS FOR MUSICAL INSTRUMENTS AND THEIR ACCESSORIES

(71) Applicant: Douglas VanHaight, Stoughton, MA (US)

(72) Inventor: Douglas VanHaight, Stoughton, MA (US)

( * ) Notice: Subject to any disclaimer, the term of this patent is extended or adjusted under 35 U.S.C. 154(b) by 0 days.

(21) Appl. No.: 16/751,848

(22) Filed: Jan. 24, 2020

(51) Int. Cl.
*G10D 1/08* (2006.01)
*G10G 5/00* (2006.01)

(52) U.S. Cl.
CPC ..... *G10G 5/00* (2013.01); *G10D 1/08* (2013.01)

(58) Field of Classification Search
CPC ..... G10G 5/00; G10D 1/08; G10D 3/00
See application file for complete search history.

(56) References Cited

U.S. PATENT DOCUMENTS 4,592,265 A 6/1986 Steinberger
4,693,161 A 9/1987 Uhrig
5,197,701 A 3/1993 Olson
6,422,522 B1 1/2002 Woollen
8,362,345 B1 * 1/2013 Rice ..... G10D 1/00 84/327
8,637,752 B2 1/2014 Innocenti
10,535,329 B2 1/2020 Berg
2018/0061380 A1 * 3/2018 Berg ..... G10D 1/085

* cited by examiner

*Primary Examiner* — Kimberly R Lockett
(74) *Attorney, Agent, or Firm* — Daly, Crowley, Mofford & Durkee LLP

(57) ABSTRACT

A load-bearing support for an object includes a sleeve, a bushing lodged in the bore of the sleeve, a bent shaft having a portion that extends through the bushing and a portion that is coupled to an undercarriage, and a tensioning device for pulling the shaft against the bushing. The bushing is notched at a desired location so that, when the support is attached to the object and the shaft is lodged in the notch, an angle is formed between the shaft and a principally vertical axis of the object to thereby support the weight of the object via a force reactive to compression of the shaft. The location of the notch may be adjusted to accommodate a variety of supported objects by rotating the bearing within the bore of the sleeve, and an exterior surface of the sleeve may be marked to permit precise rotation.

20 Claims, 19 Drawing Sheets

TILTING STANDS FOR MUSICAL INSTRUMENTS AND THEIR ACCESSORIES

FIELD

The disclosure pertains generally to load-bearing stands or supports, and more particularly to supports allowing pivoting of an attached article about a horizontal axis where the pivot angle is determined by a changeable portion of the support.

BACKGROUND

Musicians desire to place their instruments and accessories upon stands for various reasons. Some musicians may tire of carrying heavy instruments for long periods, and some may desire to tilt accessories, such as amplifiers (or loudspeaker enclosures containing amplifiers), at an angle relative to the ground in order to project sound in a particular direction. Existing stands are inconveniently heavy, and must be carried and set up separately from other musical equipment. Moreover, existing stands can be bulky and obtrusive when used, providing opportunities for musicians and stagehands to trip and injure themselves.

SUMMARY OF DISCLOSED EMBODIMENTS

Disclosed embodiments provide integrated supports for musical instruments and their accessories. The supports are lightweight yet sturdy, and may be screwed onto, or otherwise attached or adhered to, the supported objects so they may help lessen tripping hazards. Disclosed supports are capable of being locked into place to securely bear the weight of the attached object, while easily unlocked for storage. Some supports are adjustable to bear weight at a user-selected angle. A variety of mounting options are disclosed, including surface mounting and embedding within the supported object, and embodiments thus may be mounted to many different objects. Some disclosed supports include an extendable undercarriage to support especially tall or heavy objects. And supports may have an undercarriage in the form of a trestle with two supporting arms to support twice the weight.

Thus, a first embodiment is a load-bearing support for an object. The support includes a sleeve having a bore. The support also includes a bushing, protruding from the bore and having a notch. The support further includes a shaft having a first portion and a second portion, coupled by a bent portion, the first portion rotatably retained within the bushing and the second portion not retained within the bushing. The support also includes a tensioning device for pulling the bent portion of the shaft against the bushing. In a locked configuration, the tensioning device retains the bent portion of the shaft within the notch thereby preventing rotation of the shaft, while in an unlocked configuration the tensioning device does not retain the bent portion of the shaft within the notch thereby allowing rotation of the shaft.

In some embodiments, the object is a guitar, another musical instrument, an amplifier, or a loudspeaker enclosure.

In some embodiments, the second portion of the shaft comprises an undercarriage having a stabilizing arm for contacting the ground and a strut for bearing the weight of the object, the strut perpendicular to the stabilizing arm.

In some embodiments, an angle between the notch and a fixed point on the sleeve is adjustable by rotating the bushing within the bore. The sleeve may have a threaded hole, and the bushing may be secured against movement within the bore by a retaining screw disposed within the threaded hole. An exterior surface of the sleeve may have a visible marking by which to measure the angle between the notch and the fixed point. And a surface of the bushing may have a visible marking by which to measure the angle between the notch and the fixed point.

In some embodiments, the tensioning device includes a mechanical stop that prevents removal of the first portion of the shaft from the bushing, and a spring disposed between, and pressing against, the mechanical stop and an end of the sleeve. An end of the first portion of the shaft opposite the bent portion of the shaft may be threaded, and the mechanical stop may be a threaded nut. Some embodiments may include a washer, on the first portion of the shaft, disposed between the mechanical stop and the spring.

In some embodiments, the sleeve comprises a gudgeon having a gudgeon plate for attaching the sleeve to a surface of the object. The gudgeon plate may have a surface that is shaped to register with the surface of the object.

Some embodiments include a mounting plate for attaching the support to a surface of the object, wherein the sleeve comprises a gudgeon having a gudgeon plate, and the gudgeon plate is rigidly attached to the mounting plate.

In some embodiments, the second portion of the shaft comprises a second sleeve with a second bore and a second retaining screw, the support further comprising a second shaft for supporting the weight of the object. The second shaft may have a first portion and a second portion coupled perpendicularly by a second bent portion. The first portion of the second shaft may be retained within the second bore by the second retaining screw. Alternately, some embodiments may include an extension rod having a third sleeve with a third bore and a third retaining screw, wherein an end of the extension rod is retained within the second bore by the second retaining screw and the first portion of the second shaft is retained within the third bore by the third retaining screw.

Some embodiments include a second head with a common undercarriage to double the amount of supportable weight. These embodiments include a second sleeve having a second bore. They also include a second bushing, protruding from the second bore and having a second notch. They further include a second shaft having a third portion and a second portion coupled by a second bent portion, the first portion rotatably retained within the second bushing and the second portion not retained within the second bushing. In these embodiments, an angle between the notch and a fixed point on the sleeve equals an angle between the second notch and a fixed point on the second sleeve.

In some embodiments, the shaft and the second shaft are integrally formed, and the tensioning device pulls the second bent portion of the second shaft against the second bushing.

Some embodiments further have a second tensioning device for pulling the second bent portion of the second shaft against the second bushing.

DESCRIPTION OF THE SEVERAL VIEWS OF THE DRAWINGS

The manner and process of making and using the disclosed embodiments may be appreciated by reference to the drawings, in which.

DETAILED DESCRIPTION

Figure 1A:
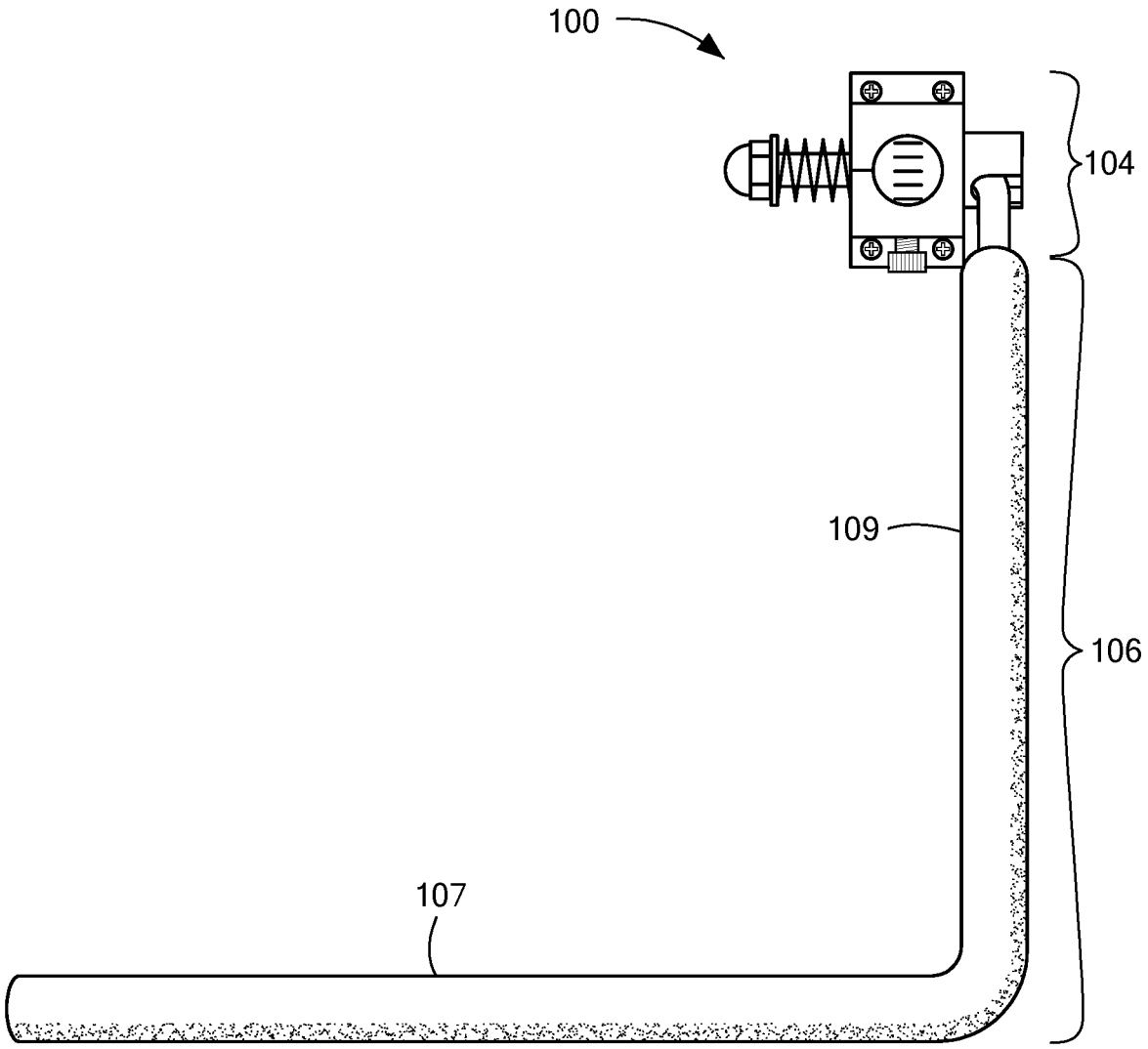
FIG. 1A is a front view of a load-bearing support, in accordance with a first embodiment of the concepts, structures, and techniques disclosed herein.

In FIGS. 1A through 1F (collectively "FIG. 1") is shown an illustrative load-bearing support 100 for supporting an object 102 in accordance with a first embodiment of the concepts, structures, and techniques disclosed herein. With reference to FIG. 1A, the support 100 includes two portions, a head 104 and an undercarriage 106. The head 104 is used to rigidly attach the support 100 to the object 102, and transmits the weight of the object 102 to the undercarriage 106 for bearing.

The support 100 has two configurations. In the first configuration, referred to herein as the "locked" configuration and described in more detail in connection with FIGS. 1B and 1C, the support 100 is suitable for bearing the weight of the object 102. In the second configuration, referred to herein as the "unlocked" configuration and described in more detail in connection with FIGS. 1D and 1E, the support 100 should not be used for bearing the weight of the object 102, but may be manipulated so that it is suitable for storage.

Figure 1B:
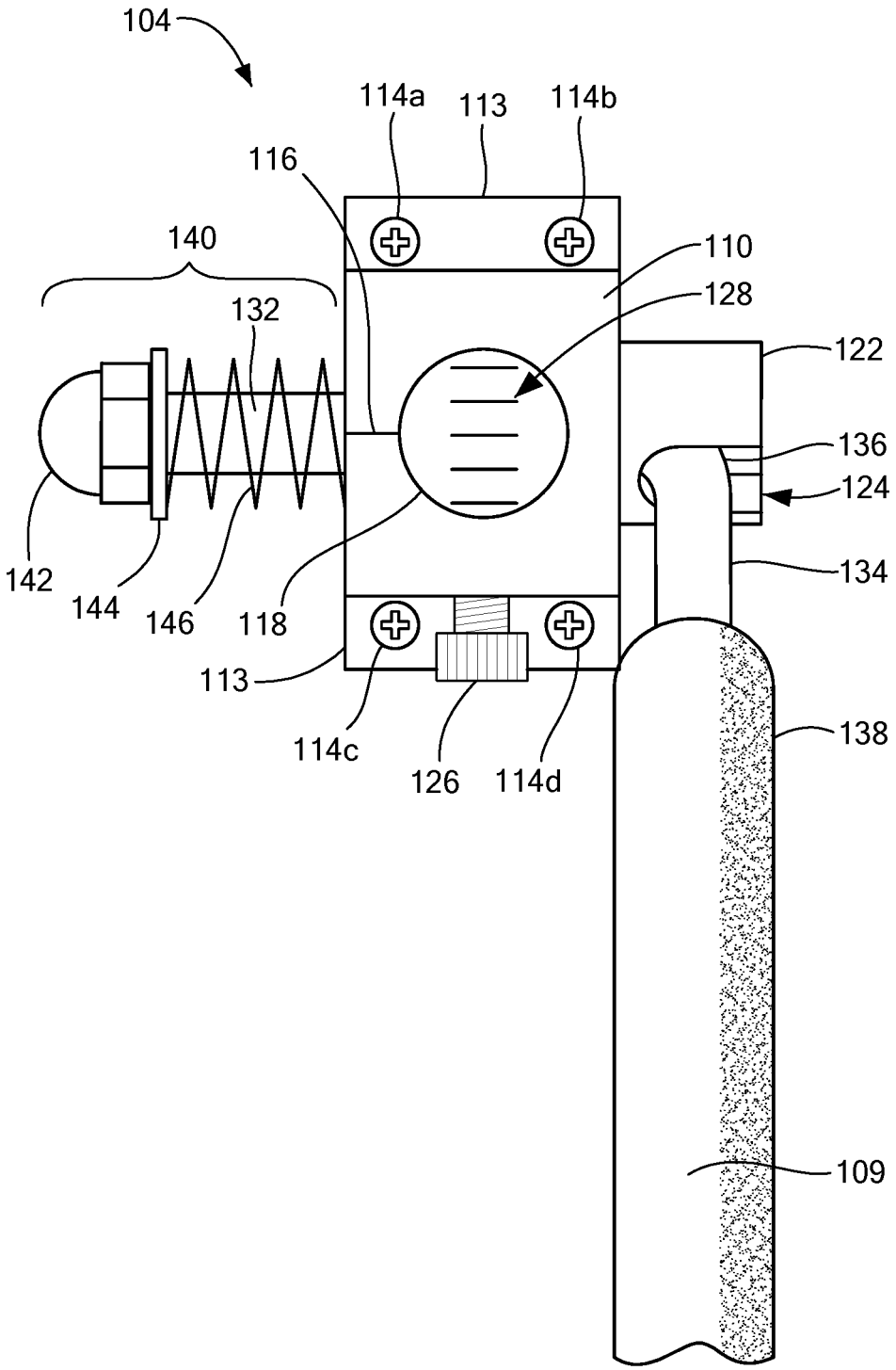
FIG. 1B is a front view of a head portion of the support of FIG. 1A in a locked configuration.
Figure 1C:
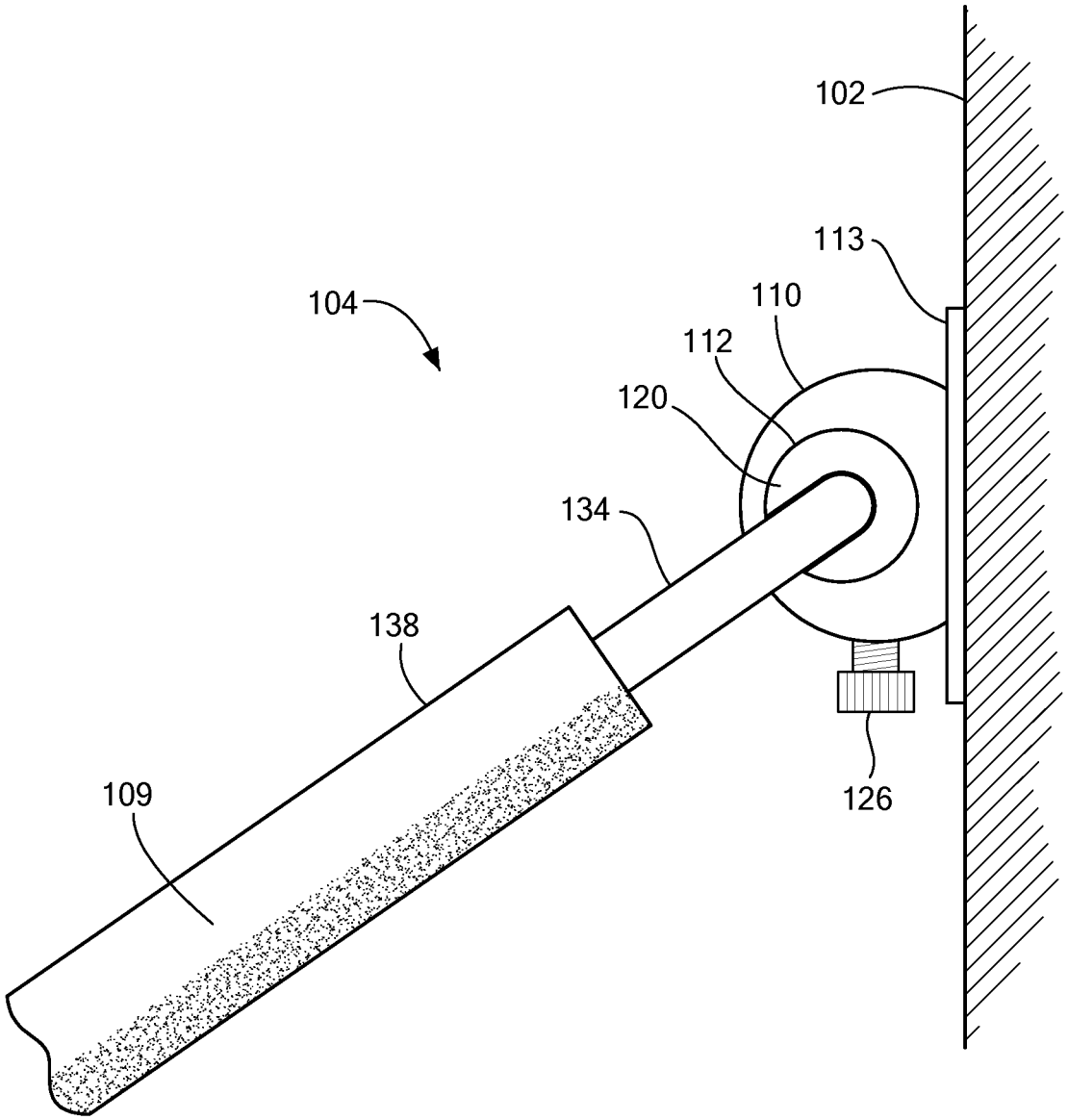
FIG. 1C is a side view of the head portion, in the locked configuration.

In FIGS. 1B and 1C are shown front and side views, respectively, of the head 104 of the support 100 in the locked configuration. The head 104 includes a sleeve 110, which may be made of any durable material such as steel or plastic. The sleeve 110 is generally cylindrical in shape, and includes a bore 112 that passes through its length. It is appreciated that the sleeve 110 may have other shapes, such as that of a gudgeon or other cylindrical fitting, and may be flattened along its length for secure registration with a surface of the object 102. The flat portion 113 may have attachment holes 114*a*-114*d* (collectively holes 114) to accommodate screws or other attachment means (e.g. adhesive means) to secure the support 100 to the object 102. The sleeve 110 also includes at least one alignment marking 116 and an alignment window 118 whose functions are described below in more detail.

The bore 112 contains a bushing 120, which may be made of any durable material such as steel or plastic. The bushing 120 has a protruding portion 122 that protrudes from the bore 112. The protruding portion 122 includes a notch 124. It may be appreciated from FIG. 1 that the rotational angle of the notch 124 with respect to the mounting plate 113 defines an angle at which the undercarriage 106 extends away from the object 102. Since a user of the support 100 may wish to adjust this angle, in various embodiments the bushing 120 is rotatable within the bore 112.

The illustrative embodiment of FIG. 1 therefore includes a screw 126 (e.g. a set screw) that penetrates the sleeve 110 to contact the bushing 120. When tightened, the screw 126 retains the bushing 120 in a fixed position against rotation, especially when the support 100 is being used to bear the weight of an object 102. When untightened, the screw 126 allows the bushing 120 to rotate within the bore 112 so that a user may set the angle of the notch 124.

To permit fine-grained adjustment of the angle of the notch 124, the embodiment of FIG. 1 includes the above-mentioned alignment marking 116 and alignment window 118 on the exterior of the sleeve 110, and alignment markings 128 on the exterior of the bushing 120. The alignment marking 116 may be made using any durable marking technique, including paint or etching, and various embodiments may include another alignment marking (not shown) opposite the alignment window 118. The alignment window 118 may be made, for example, of any suitable transparent material such as plastic or glass, or may be an opening in the material of the sleeve 110. In embodiments, the alignment markings 128 may be regularly spaced, and the distance between each such marking may correspond to a fixed angular increment or position of the bushing 120 within the bore 112. Thus, for example, the alignment markings 128 may include numbers (not shown) indicating the angle of the notch 124 with respect to the mounting plate 113, so that a precise angle of support may be obtained.

In accordance with the embodiment of FIG. 1, a user may adjust the angle of the notch 124 as follows. First, the user untightens the screw 126 to free the bushing 120 to rotate within the bore 112. Next, with a desired notch angle in mind, the user rotates the bushing 120 within the bore 112 until the correct marking 128 is aligned with the fixed alignment marking 116. Finally, the user tightens the screw 126 to secure the bushing 120 against further rotation.

It is appreciated that various embodiments may include other or additional means for allowing the bushing 120 to rotate within the bore 112, or may instead lock the notch 124 at a fixed angle. For example, the bushing 120 could be extended to protrude from both sides of the bore 112 far enough to permit retaining rings (e.g. "e-rings" or "e-clips") to be clipped or otherwise placed on the bushing 120, thereby retaining it at a fixed lateral position during rotation so that the alignment markings 128 remain centered when the screw 126 is loosened. It is further appreciated that the location of the screw 126 along the length of the sleeve 110 may be other than in its center (as shown in FIG. 1), and that the Figures are merely illustrative in this regard.

The head 104 portion of the support 100 is coupled to the undercarriage 106 via a shaft, which may be made of any material, such as steel, having a compressive strength sufficient to bear the weight of the object 102. The shaft has a first portion 132 and a second portion 134 separated by a bent portion 136. The shaft may be manufactured, for example, by bending a straight steel rod to form the various portions 132, 134, 136.

The first portion 132 of the shaft is rotatably retained within the bushing 120, while the second portion 134 of the shaft is not retained within the bushing 120. The second portion 134 of the shaft rotates easily by hand about an axis of rotation along the length of the bushing 120 when the bent portion 136 is not retained securely within the notch 124. The first portion 132 may be lubricated for this purpose. The second portion 134 of the shaft 130 couples the head 104 to the undercarriage 106, and may be covered by a protective sleeve 138 that is made, for example, from rubber.

The first portion 132 is retained within the bushing by a tensioning device 140. In the illustrative embodiment of FIG. 1, the tensioning device 140 includes a mechanical stop 142, a washer 144, and a spring 146. The stop 142, shown as a nut in the Figure, screws onto the end of the first portion 132 of the shaft, which may be threaded for this purpose. Among other things, the presence of the stop 142 prevents the first portion 132 from being withdrawn from the bushing 120, while conversely allowing for easy assembly of the tensioning device when the support 100 is being manufactured or repaired. The washer 144 is present to provide a large circular area against which the spring 146 may push, among other reasons. It is appreciated that mechanical stops other than a nut may be used in accordance with various embodiments, and that the presence of the washer 144 is optional.

The spring 146 provides a tensioning force pushing the stop 142 and washer 144 away from the sleeve 110. As the stop 142 is screwed onto the end of the first portion 132 of the shaft 130, this force retains the bent portion 136 of the shaft against the protruding portion 122 of the bushing. In particular, this force retains the bent portion 136 within the notch 124, thereby preventing rotation of the shaft, when the support 100 is in the locked configuration of FIGS. 1B and 1C. The amount of tensioning force should be greater than a maximum lateral force expected on the supported object 102 during normal use, but small enough to permit a person to pull on the second portion 134 of the shaft to thereby unlock the bent portion 136 and rotate the undercarriage 106 into the unlocked configuration.

The second portion 134 of the shaft extends into, and forms part of, the undercarriage 106. In particular, the second portion 134 itself may be bent to form an undercarriage 106 having a stabilizing arm 107 for contacting the ground and a strut portion 109 for bearing the weight of the object 102 under compression. In illustrative embodiments, the strut portion 109 is perpendicular to the stabilizing arm 107. The stabilizing arm 107 suppresses lateral roll of the object 102 while it is being supported by the support 100.

Figure 1D:
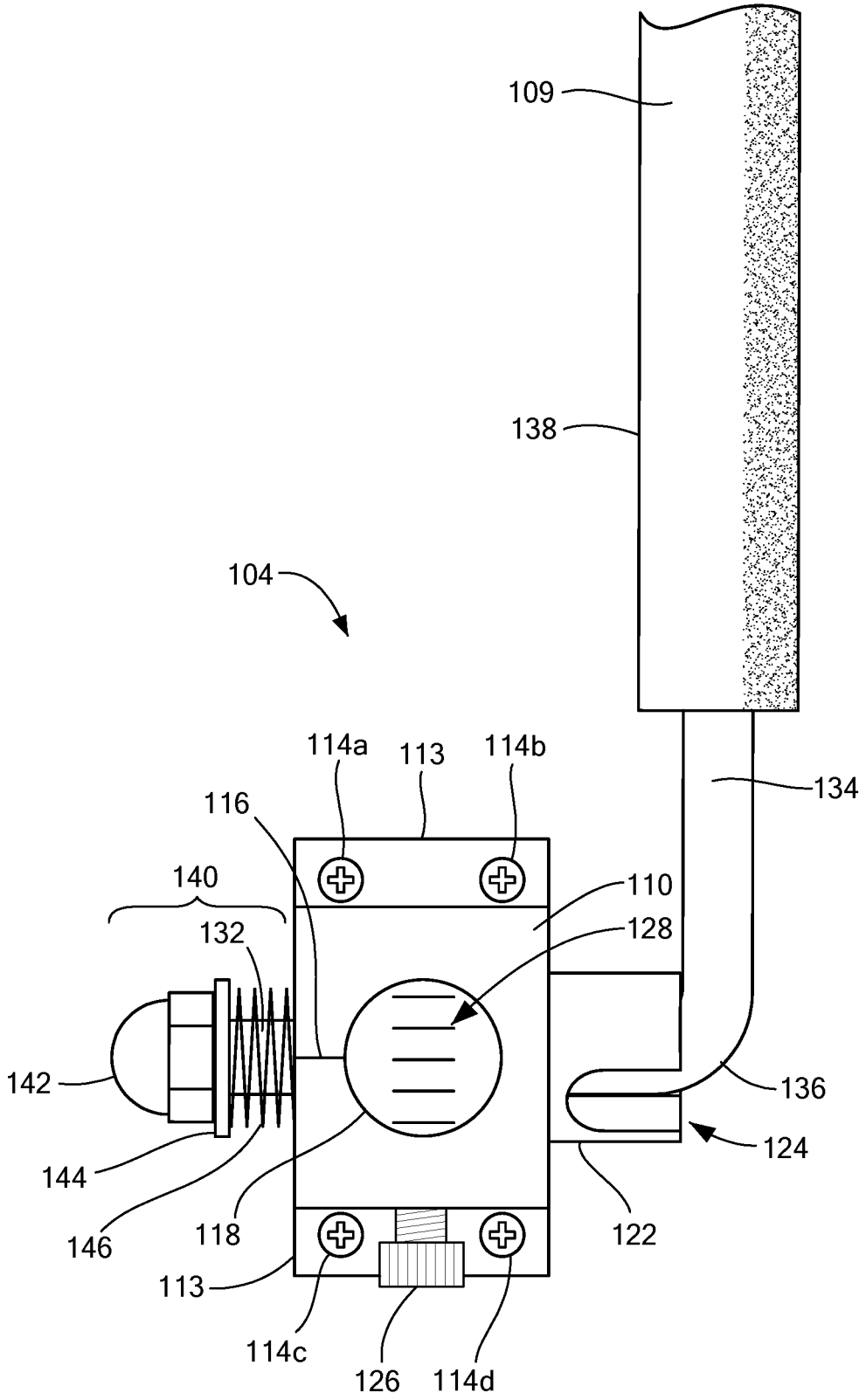
FIG. 1D is a front view of the head portion, in an unlocked configuration.
Figure 1E:
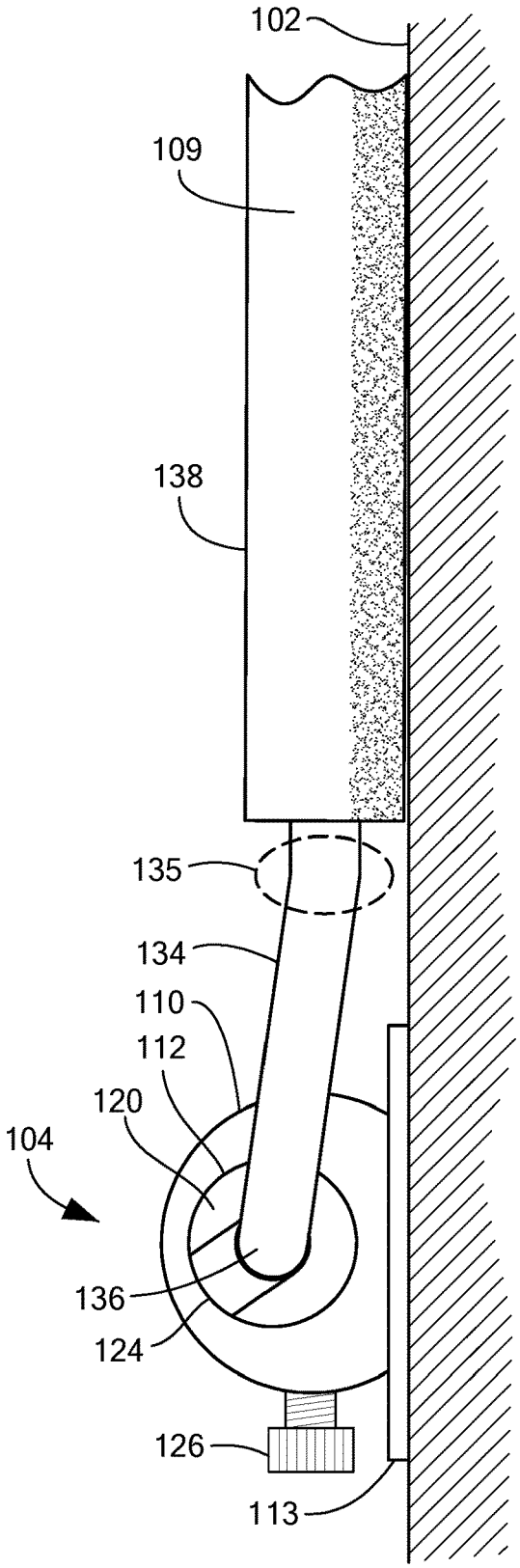
FIG. 1E is a side view of the head portion, in the unlocked configuration.

In FIGS. 1D and 1E are shown front and side views, respectively, of the head 104 of the support 100 with the undercarriage 106 in the unlocked configuration. In these Figures, the bent portion 136 of the shaft has been dislodged from the notch 124, and the undercarriage 106 has been rotated so that it contacts the object 102, e.g. for storage of the support 100.

It is appreciated that magnetic attraction may be used to retain the undercarriage 106 against the object 102 if the former is made of magnetic material. Thus, if the object 102 itself is magnetic, or if a magnet is affixed thereto, the undercarriage 106 may be held by magnetic forces against a surface of the object 102 for storage. It is further appreciated that the undercarriage 106 may be stored in other ways, for example if the object 102 itself includes a groove into which the stabilizing arm 107 and strut portion 109 may be rotated, or if a clip is attached to the object 102 for grasping and removably retaining the undercarriage 106.

It is appreciated that the axis of rotation of the bushing 120 is offset from the surface of the object 102 by a finite distance, and that the undercarriage 106 of the shaft therefore may not register precisely against the object 102 when the support 100 is stored. Therefore, the second portion 134 of the shaft may include a small bend 135 to align the undercarriage 106 with the surface of the object 102.

Figure 1F:
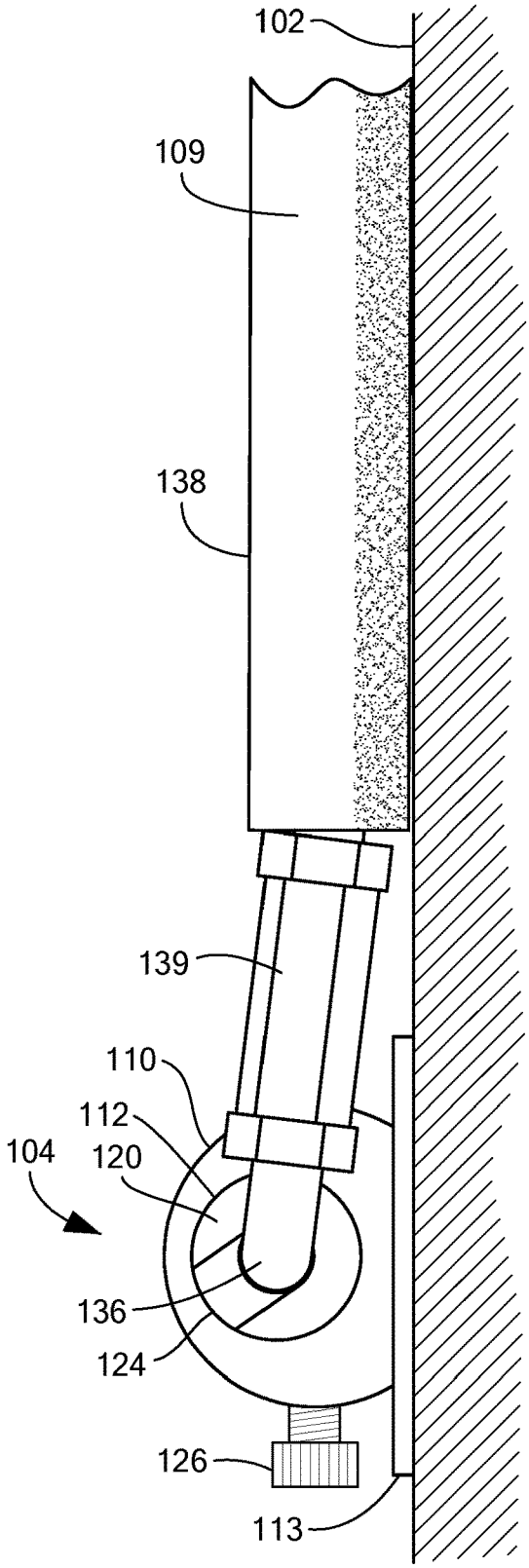
FIG. 1F is a side view of the head portion in a variation on the first embodiment.

In FIG. 1F is shown a side view of the head 104 in a variation on the support 100, in which the second portion 134 and the small bend 135 have been replaced by an undercarriage angle adjuster 139. The angle adjuster 139 may be used to adjust an angle of (i.e. twist) the stabilizing arm 107 about the strut portion 109. Thus, in the stored configuration both the stabilizing arm 107 and the strut portion 109 of the undercarriage 106 lie flush against a rear surface of the object 102, while in the locked configuration the stabilizing arm 107 may be adjusted to lie flush along the ground at a different angle. The angle adjuster 139 of FIG. 1F is shown using two hex nuts and a threaded hexagonal sleeve, however it is appreciated that other structures may be used for this purpose.

Figure 2A:
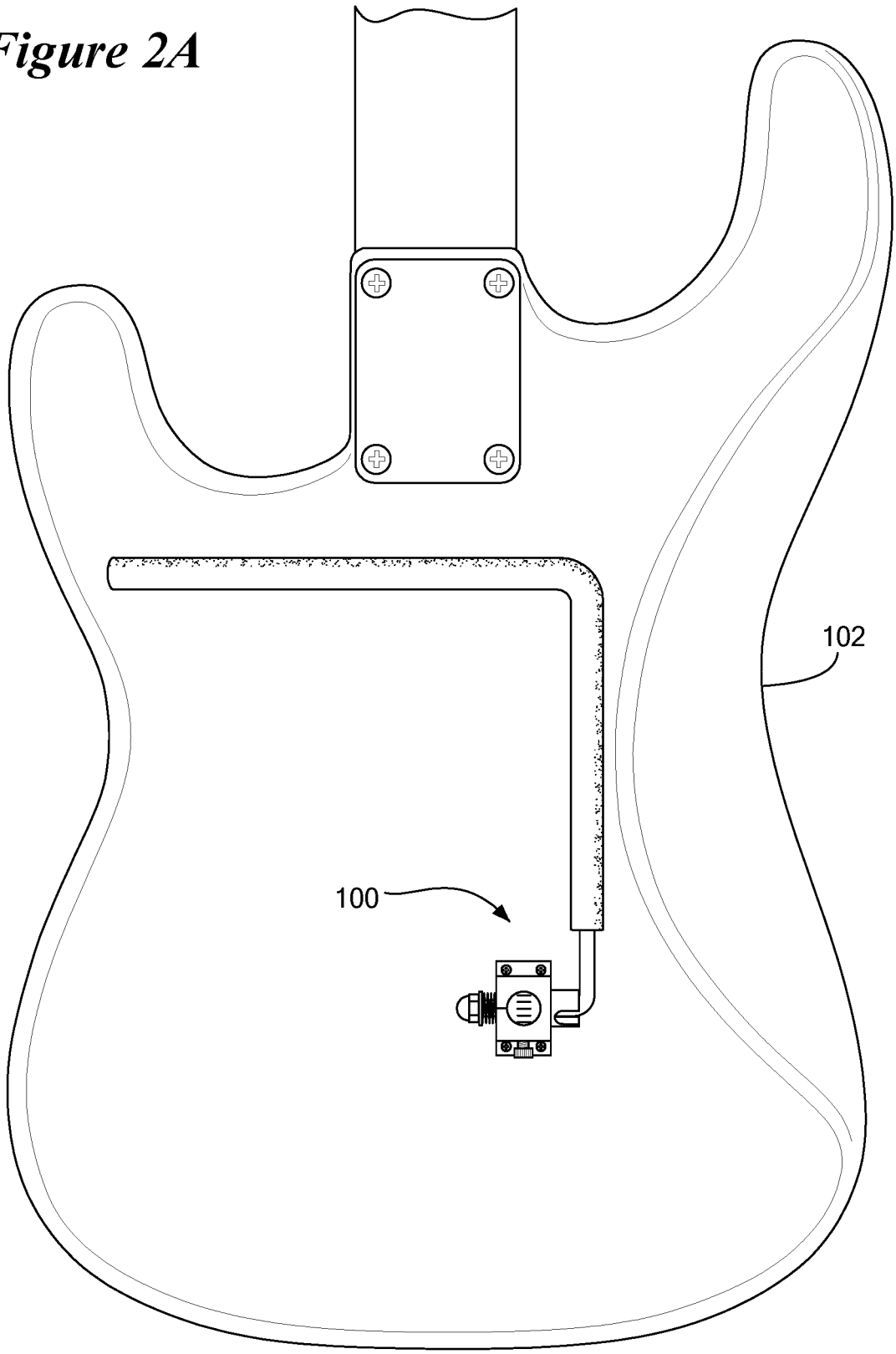
FIG. 2A is a front view of the load-bearing support attached to a rear surface of a musical instrument in the unlocked configuration for storage.
Figure 2B:
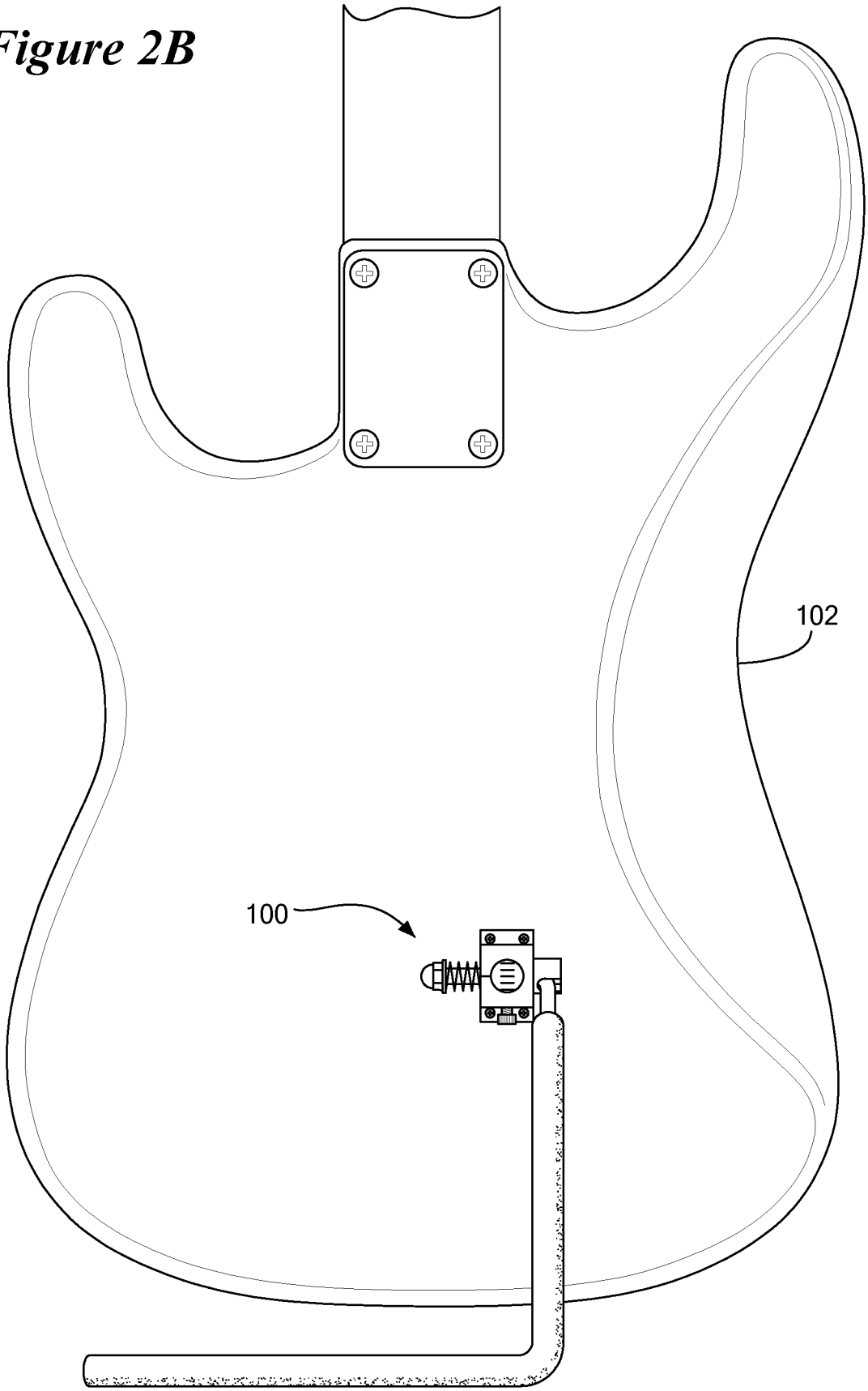
FIG. 2B is a front view of the load-bearing support in the locked configuration.
Figure 2C:
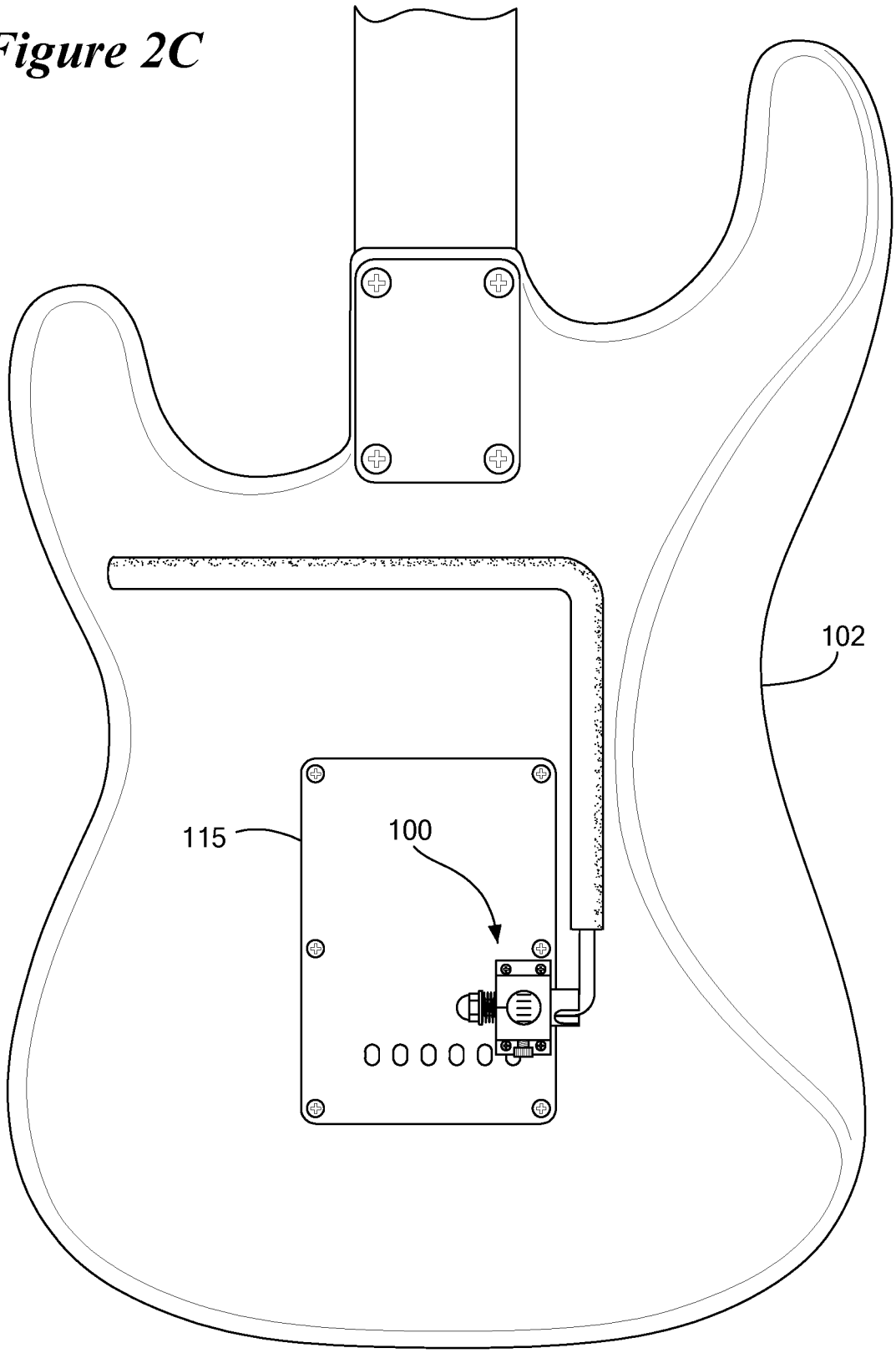
FIG. 2C is a front view of the load-bearing support in the unlocked configuration, attached to a mounting plate on a rear surface of the musical instrument.

In FIGS. 2A, 2B, and 2C (collectively "FIG. 2") is shown a front view of the load-bearing support 100 placed onto an object 102. In FIG. 2, the object 102 is a guitar, although embodiments may be used to support other objects, especially but not limited to musical instruments such as cellos or basses, especially when those instruments are being displayed or otherwise not being played.

FIG. 2A shows the support 100 in its unlocked configuration, for storage, and FIG. 2B shows the same support 100 in its locked, weight-bearing configuration. Note that in FIGS. 2A and 2B, the support 100 is attached directly to the object 102 using screws through the holes 114. However, in the alternate embodiment of FIG. 2C, the support 100 is attached to a mounting plate 115 that in turn is attached directly to the object 102. In this connection, the support 100 may be bolted, glued, or welded to the mounting plate 115.

The mounting plate 115 may be provided as part of the support 100, or separately as an accessory. The mounting plate 115 may permanently attach to the object 102 using screws, as shown, or may be removably attached to the object 102 using other attachment means (e.g. adhesive means). The mounting plate 115 may be configured according to the object 102. For example, in FIG. 2C the mounting plate 115 has six holes for accessing the pickups of an electric guitar from the rear. It is anticipated that other embodiments may provide a mounting plate having a different size, shape, or design, with or without holes, or having different types, numbers, and placement of through-holes for purposes relating to other musical instruments or objects 102 being supported.

Figure 3:
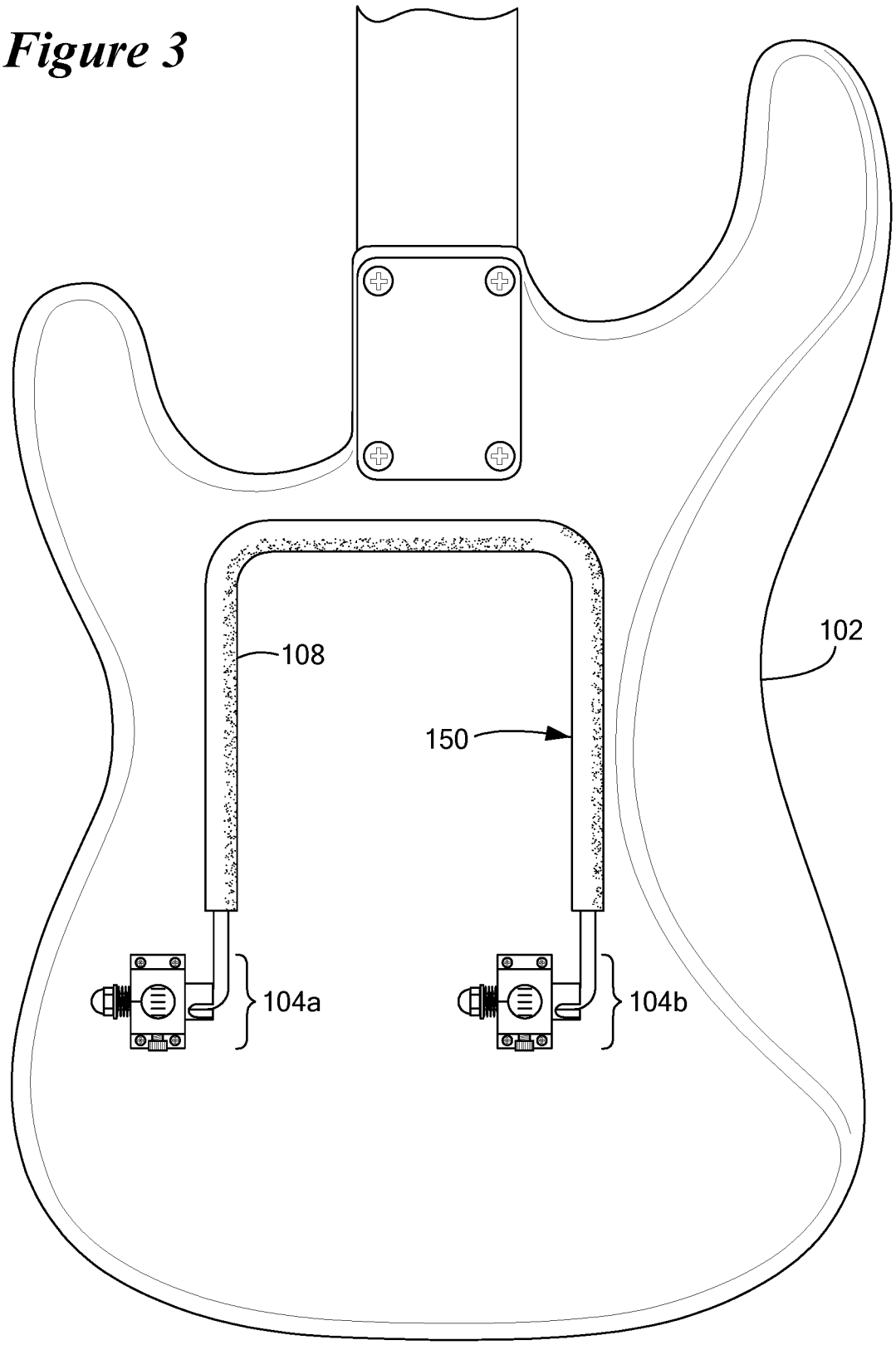
FIG. 3 is a front view of a load-bearing double support, in accordance with a second embodiment, in the unlocked configuration for storage.

In FIG. 3 is shown a front view of a load-bearing double support 150, in accordance with a second embodiment, in the locked configuration. The double support 150 of FIG. 3 has a single undercarriage 108 that connects two head portions 104*a* and 104*b* that are identical to the head 104 of FIGS. 1 and 2, and have notches on the same side to facilitate locking and unlocking. The double support 150 may support objects that are twice as heavy as the support 100, provided lateral frictional forces are sufficient where the undercarriage 108 contacts the ground, because the undercarriage 108 has two arms that are combined to form a trestle.

It is appreciated that, in the double support 150, the angle between the notch and a fixed point on the sleeve of the first head portion 104*a* equals an angle between the notch and a fixed point on the sleeve of the second head portion 104*b*. It is further appreciated that the double-arm undercarriage 108 is only one design to increase the supportable weight of a support in accordance with the concepts, techniques, and structures taught herein, and other designs are possible without deviating from those teachings.

In a variation of the support 150, one or more additional horizontal, bracing bars (not shown) may be provided between the two arms of the double-arm undercarriage 108 to stiffen them. Such bracing bars may be included in some embodiments to increase the mechanical resistance of the undercarriage 108 against lateral forces thereupon, and to prevent the undercarriage 108 from bending.

Figure 4A:
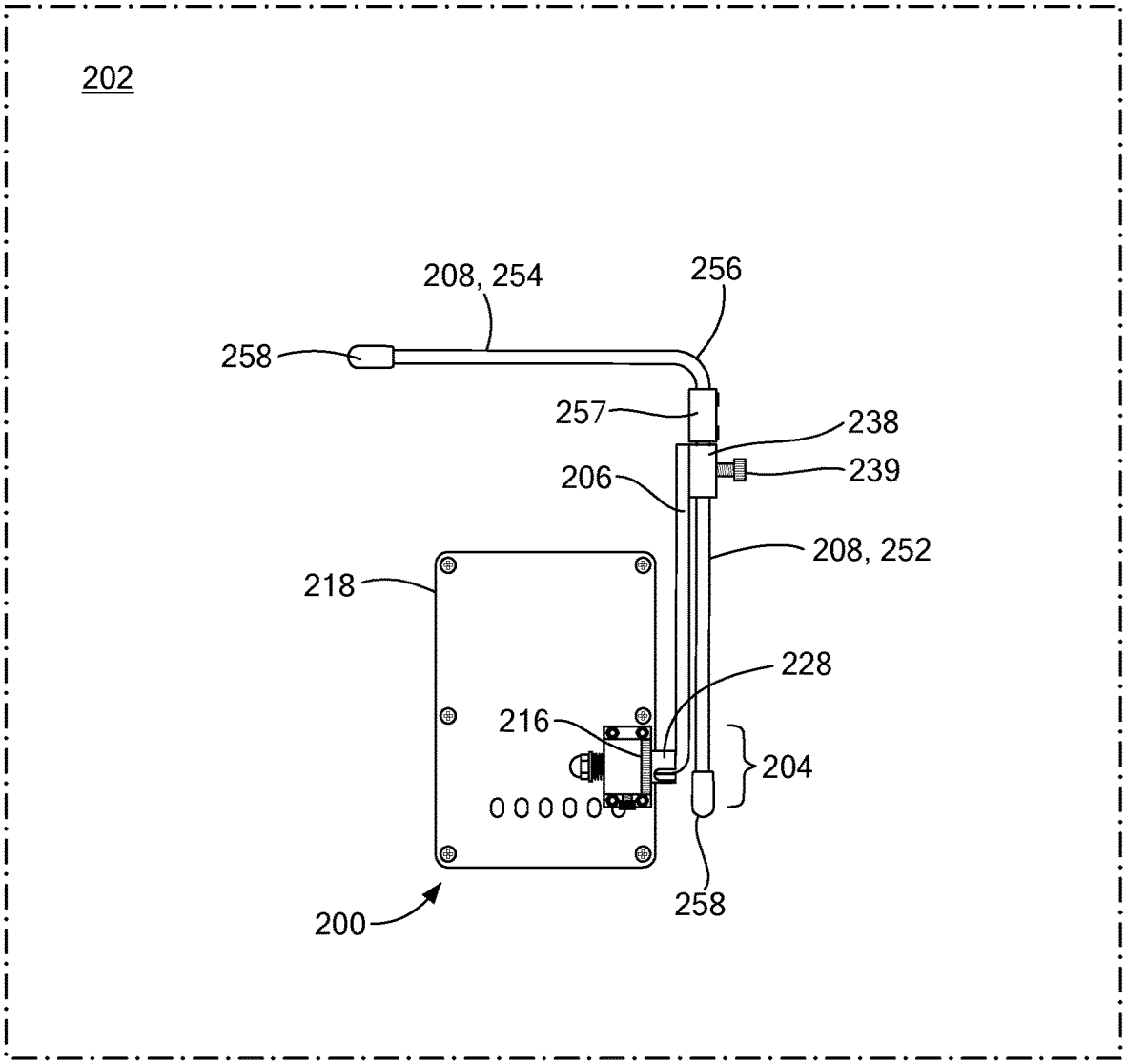
FIG. 4A is a front view of a load-bearing extendable support in accordance with a third embodiment, in an unlocked, non-extended configuration.

In FIGS. 4A through 4H (collectively "FIG. 4") are shown an illustrative load-bearing extendable support 200 in accordance with a third embodiment. In the illustrative embodiment of FIG. 4, the extendable support 200 supports a tall or heavy object 202, which is illustratively a loudspeaker enclosure containing an amplifier. With reference to FIG. 4A, the extendable support 200 includes two portions, a head 204 and an undercarriage having a first portion 206 and a second portion 208. The head 204 is used to rigidly attach the extendable support 200 to the object 202, and transmits the weight of the object 202 to the undercarriage 206, 208 for bearing.

The extendable support 200 is similar to the support 100 in many aspects. In particular, the support 200 may be used in both a locked or weight-bearing configuration, and an unlocked or stored configuration. The head 204 includes a sleeve having a bore, a bushing in the bore having a notched protrusion, a shaft having a first portion and a second portion coupled by a bent portion. The shaft is retained within the bushing by a tensioning device. The head 204 operates to switch between the locked and unlocked configurations in the same manner as described above in connection with FIGS. 1 through 3. Other features of the extendable support 200 are described above in connection with support 100; the description that follows is directed to the differences between the extendable support 200 and the support 100.

In accordance with the illustrative embodiment of FIG. 4, the sleeve of the support 200 enables a different method of adjusting an angle between the notched protrusion and a surface of the object 202. Thus, rather than provide spaced markings on the surface of the bushing and a window through the sleeve to view the markings, as described above, the support 200 places the adjustment markings 216 on the surface of the sleeve itself, and provides a single adjustment marking 228 on the protruding portion of the bushing. By aligning the adjustment markings 216 and the adjustment marking 228, the angle of the notch can be set with at least as fine a precision as the alignment structure described above. It is appreciated that other structures for setting the angle of the notch may be found in various embodiments without deviating from the concepts disclosed herein.

The head 204 of the extendable support 200 includes, by way of illustration, a separate mounting plate 218. The sleeve may be secured to the mounting plate 218 (e.g. using screws) for mounting the support 200 to the object 202. The mounting plate 218 itself may be attached to the object 102 via screws, as shown in FIG. 4, or via some other, non-destructive means such as Velcro strips, two-sided tape, or removable adhesive mounting strips known (not shown). It is appreciated that other structures for mounting the support 200 to the object 202 may be found in various embodiments without deviating from the concepts disclosed herein.

It is further appreciated that, in general, the structures and operation of the head 204 are functionally independent of the extendable nature of the support 200, as described below, and may be substituted into embodiments according to FIGS. 1 through 3.

The extendable support 200 is now described. The support 200 improves upon the support 100 in that the undercarriage is extendable, and therefore the support 200 advantageously may be used to support taller or heavier objects. The undercarriage has two portions. The first portion 206 of the undercarriage is the second portion of the shaft, and is rotatably supported by the bushing in the head 204. The second portion 208 of the undercarriage is mechanically extendable with respect to the first portion 206, and is a second shaft having a first portion 252 and a second portion 254 connected by a bent portion 256.

To enable extension of the second portion 208 of the undercarriage, the first portion 206 of the undercarriage includes, at its extremity, a second sleeve 238 having a second bore and a retaining screw 239 for retaining the straight portion 252 at a fixed position through the second bore. It is appreciated that in various embodiments the straight portion 252 of the second shaft may have a D-shaped cross-section to permit the retaining screw 239 to more securely engage its surface and to prevent the straight portion 252 from rotating within the second sleeve 238. It is also appreciated that the second sleeve 238 may have more than one retaining screw 239 to provide additional security against relative motion of the straight portion 252 through the bore.

The straight portion 252 may include a second mechanical stop 257. The position of the stop 257 may be adjusted to occupy a desired position along the straight portion 252 to provide additional support, using structures and techniques known in the art (e.g. set screws). The first portion 252 and the second portion 254 may be capped with tips 258. In particular, the tip 258 on the first portion 252 may be used to prevent the portion 208 of the undercarriage from passing through the bore and becoming detached from the support 200.

In accordance with the embodiment of FIG. 4, a user may extend the undercarriage of the support 200 as follows, thereby changing the support from a non-extended configuration to an extended configuration. First, the user untightens the retaining screw 239 that holds the portion 208 fixed within the bore of the second sleeve 238. Next, the user pulls the portion 208 until the length of the undercarriage portions 206 and 252 have a desired length. Finally, the user tightens the retaining screw 239 to secure the straight portion 252 against further movement through the bore. In embodiments having more than one retaining screw 239, all screws should be untightened, then retightened, in the appropriate steps.

Figure 4B:
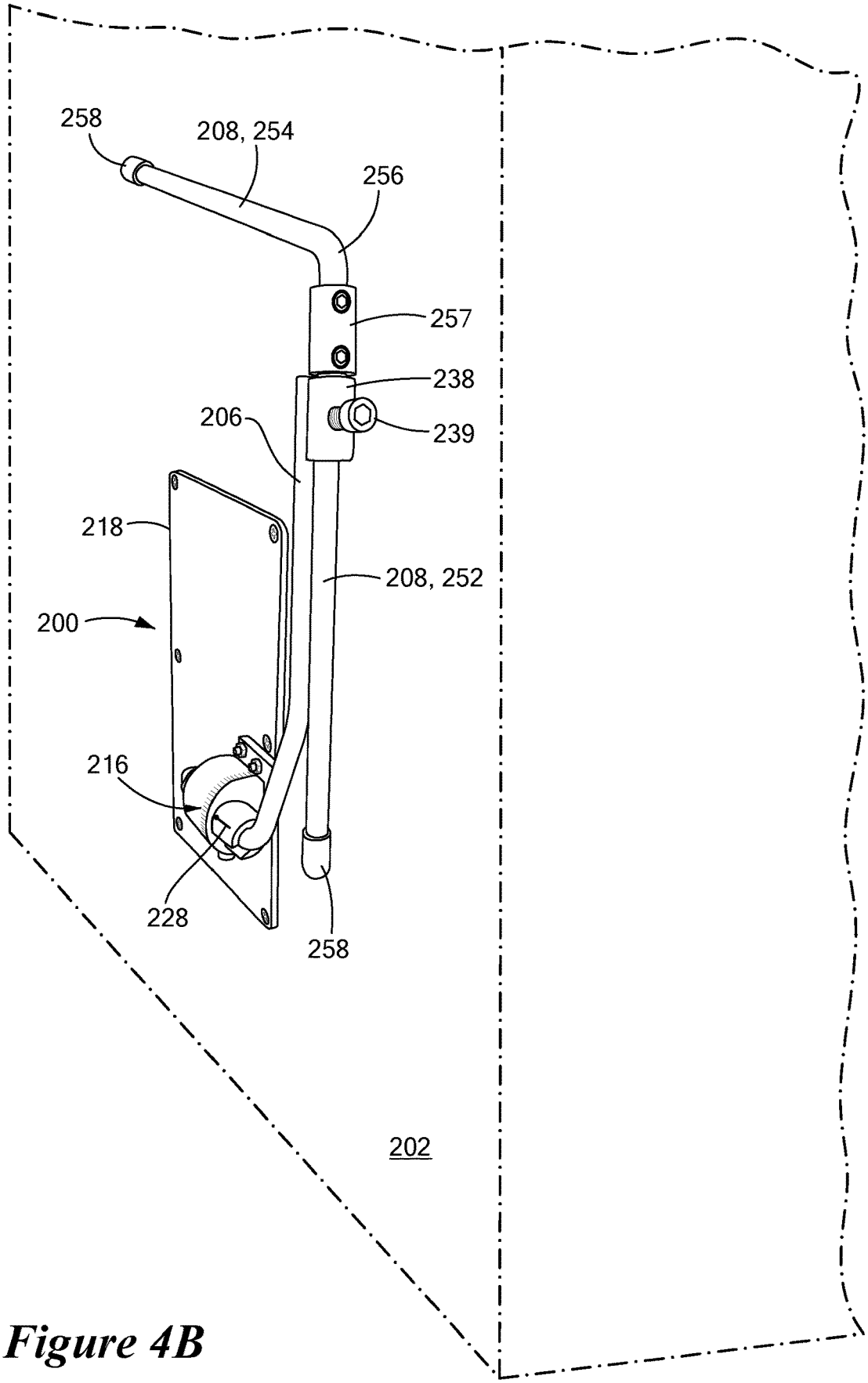
FIG. 4B is a side perspective view of the load-bearing extendable support in the unlocked, non-extended configuration.
Figure 4C:
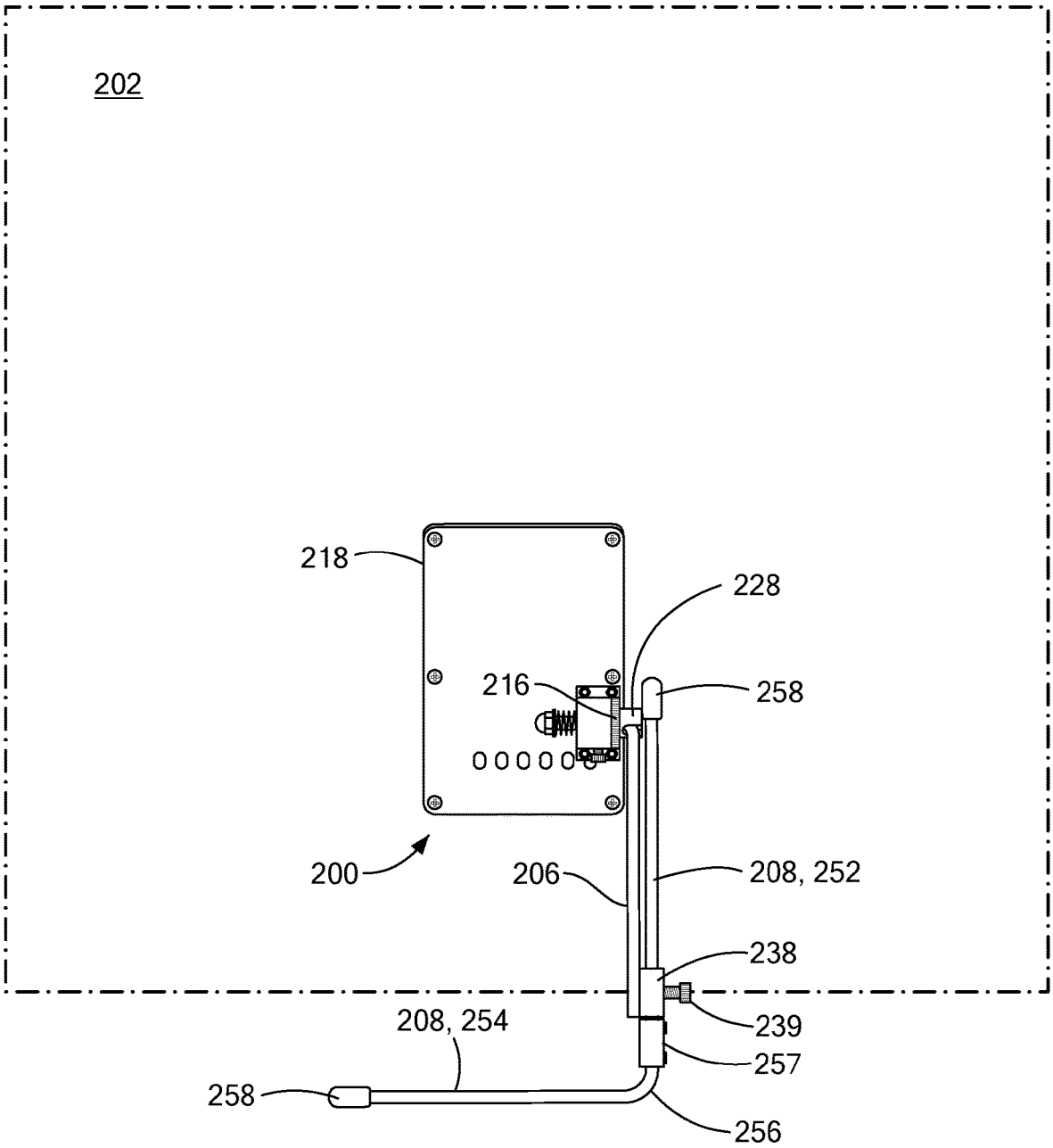
FIG. 4C is a front view of the load-bearing extendable support in a locked, non-extended configuration.
Figure 4D:
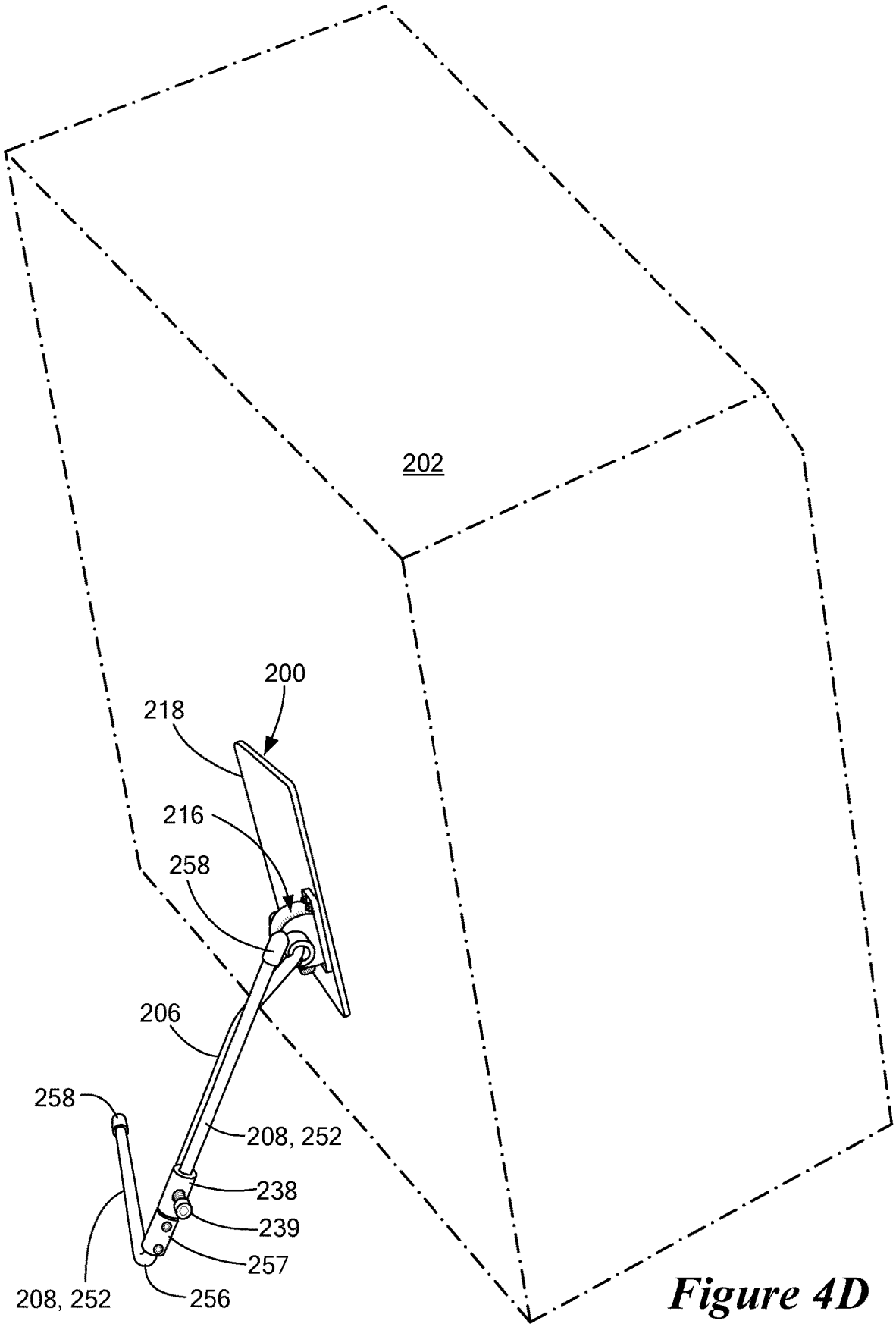
FIG. 4D is a side perspective view of the load-bearing extendable support in the locked, non-extended configuration.
Figure 4E:
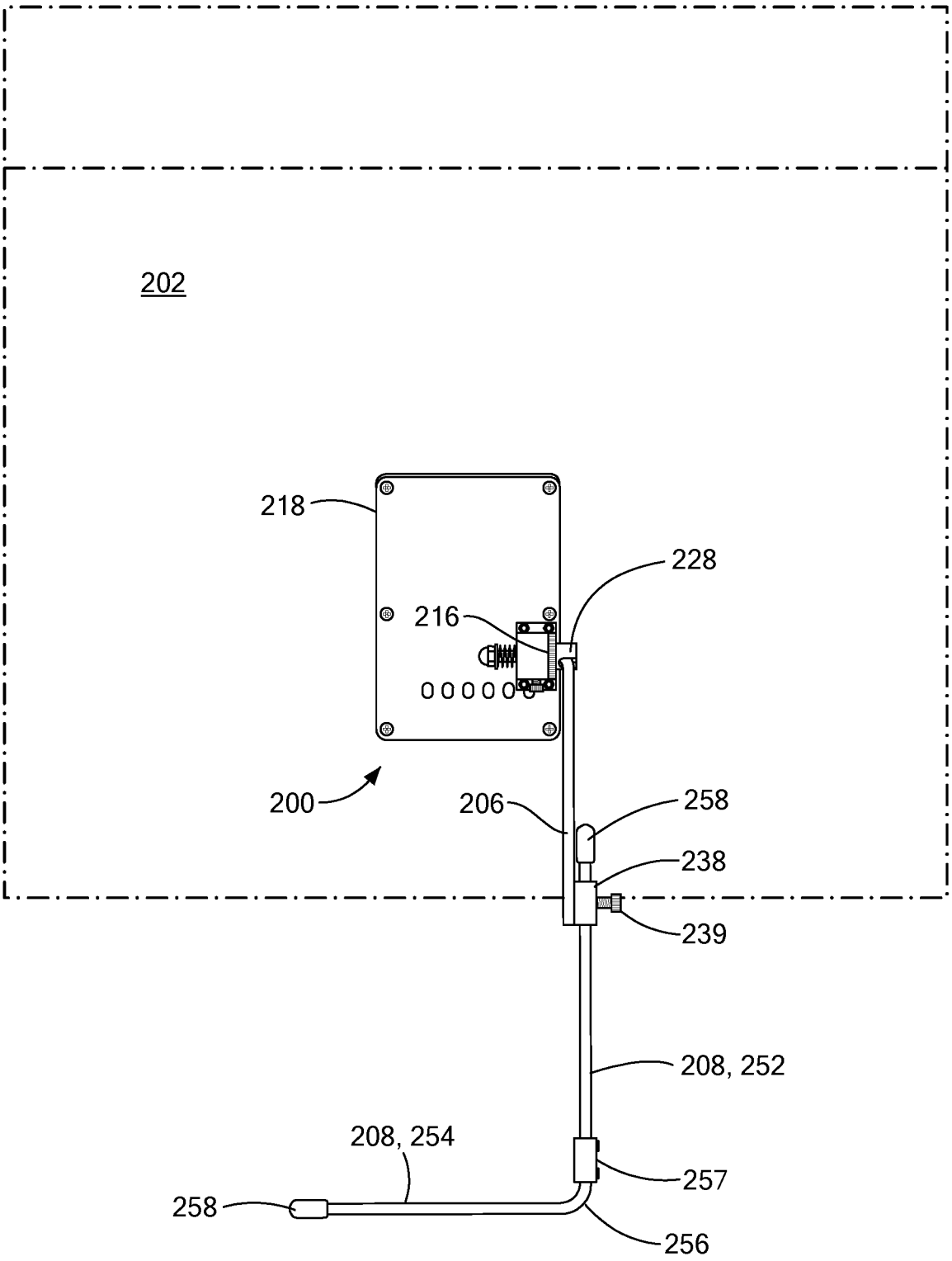
FIG. 4E is a front perspective view of the load-bearing extendable support in a locked, extended configuration.

With these features in mind, in FIGS. 4A and 4B are shown a front view and a side perspective view, respectively, of the support 200 attached to an object 202 in the stored, non-extended configuration. In FIGS. 4C and 4D are shown a front view and a side perspective view, respectively of the support 200 in the locked, non-extended configuration. In FIG. 4E is shown a front perspective view of the support 200 in the locked, extended configuration.

Figure 4F:
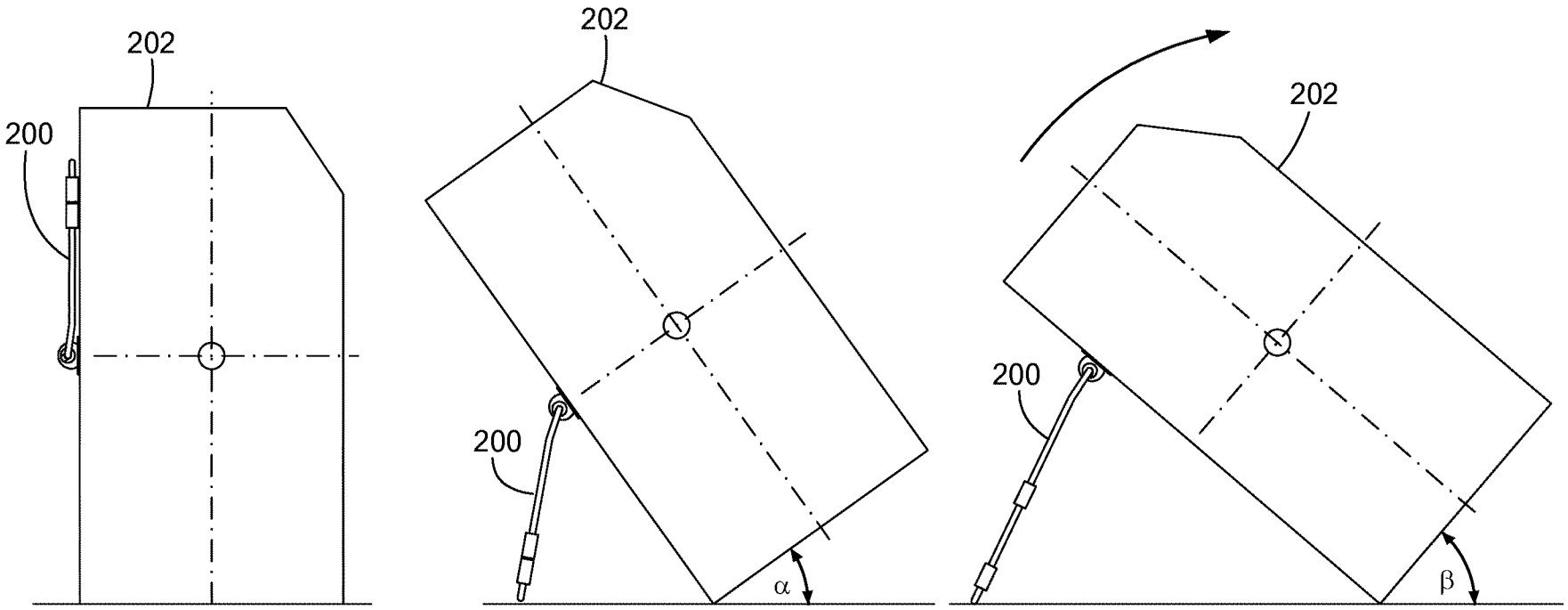
FIG. 4F is a series of side views of the load-bearing extendable support in the stored, locked, and locked extended configurations, respectively.

In FIG. 4F are shown three representations of tilt that may be generated by the support 200. In the first representation, which corresponds to the stored, non-extended configuration of FIGS. 4A and 4B, the object 202 rests with its bottom flat against the ground. In the second representation, which corresponds to the locked, non-extended configuration of FIGS. 4C and 4D, the support 200 is locked so that the object 202 is tilted backward at an angle $\alpha$. In the third representation, which corresponds to the locked, extended configuration of FIG. 4E (and in which the attachment point of the support 200 has been moved toward a top of the rear surface of the object 202), the support 200 is locked and extended so that the object 202 is tilted backward even farther, at an angle $\beta$ that is greater than the angle $\alpha$. It is appreciated that the angle of the undercarriage with respect to the head is different between the second and third representations. This difference may be achieved by changing the angle of the notch with respect to the rear surface of the object, as described above.

Figure 4G:
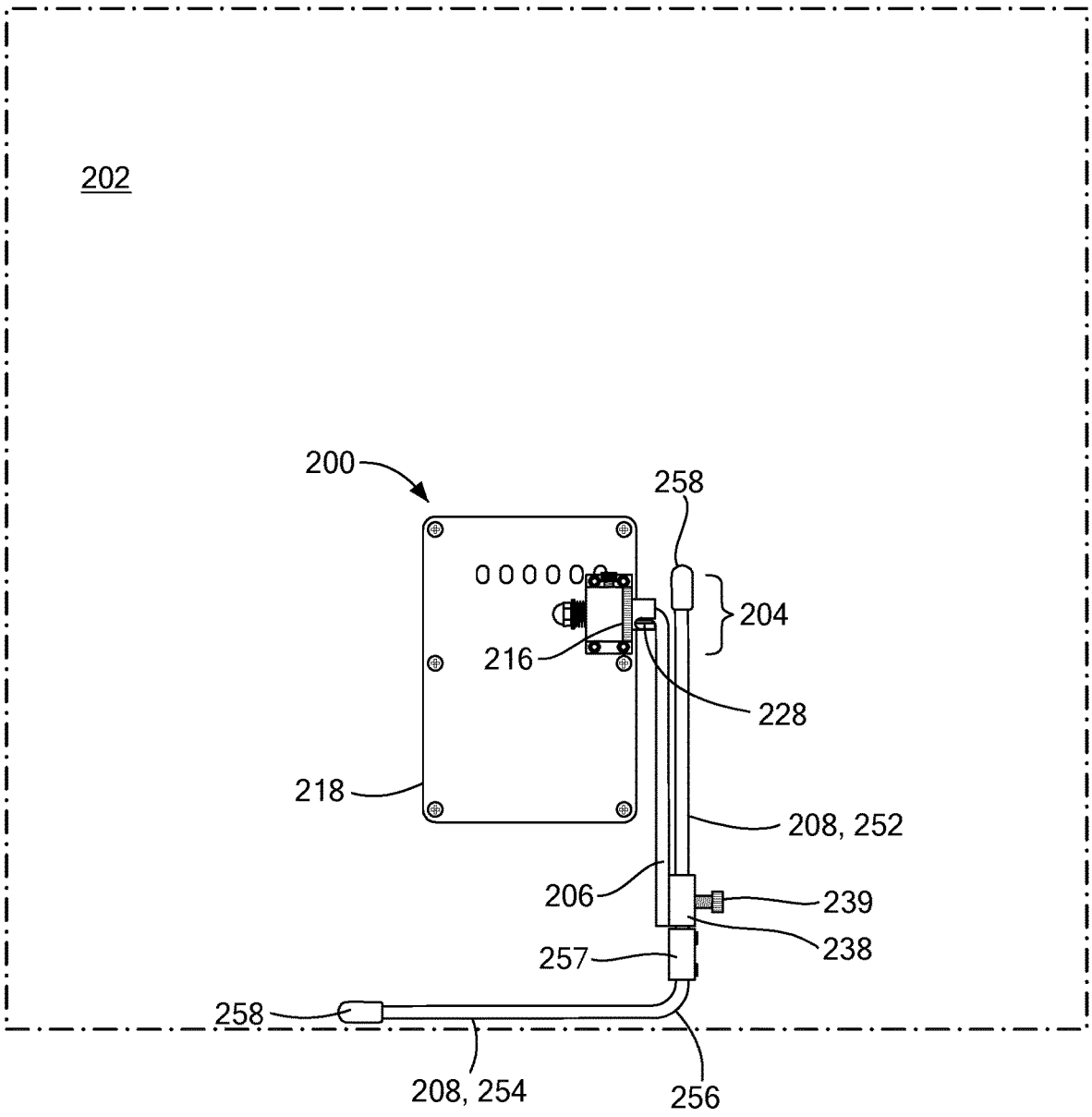
FIG. 4G is a front view of the load-bearing extendable support in an unlocked, non-extended configuration adjusted to have a different storage mode.

In FIG. 4G is shown a front view of the support 200 in an unlocked, non-extended configuration, adjusted to have a different storage mode. That is, by contrast with FIG. 4A, the embodiment of FIG. 4G stores the extendable undercarriage toward a bottom of the object 202, rather than toward its top. To accommodate this change, the support 200 may be attached to the rear surface of the object 202 at a different height than as depicted in FIG. 4A. It is appreciated that the height of the support 200 on the rear surface of the object 202 will determine a range of angles at which the object 202 may be supported, and that a person having ordinary skill in the art will be able to determine the appropriate height at which to mount the support 200.

Figure 4H:
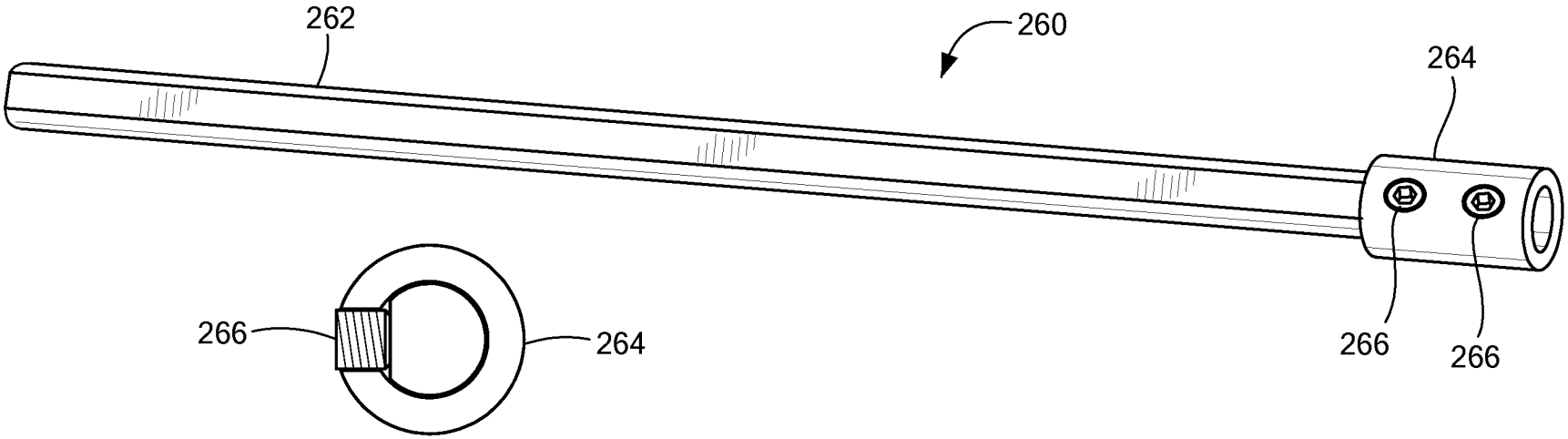
FIG. 4H is a perspective view of an extension rod for use in accordance with the load-bearing extendable support.

In FIG. 4H are shown two views of an extension rod 260 for use with the support 200. The extension rod 260 has a shaft 262 and a sleeve 264 with retaining screws 266. The extension rod 260 may be used to lengthen the undercarriage of the support 200 by a fixed length. It is appreciated that a number of extension rods 260 may be provided in varying lengths for this purpose.

In accordance with various embodiments, the extension rod 260 is used to replace the straight portion 252 of the undercarriage. That is, the bore of the second sleeve 238 retains the shaft 262 of the extension rod 260 using the retaining screw 239, and the auxiliary sleeve 264 of the extension rod 260 retains the straight portion 252 of the undercarriage using the retaining screws 266. By connecting multiple extension rods 260 together end-to-end, any desired length of the undercarriage may be produced.

Figure 5:
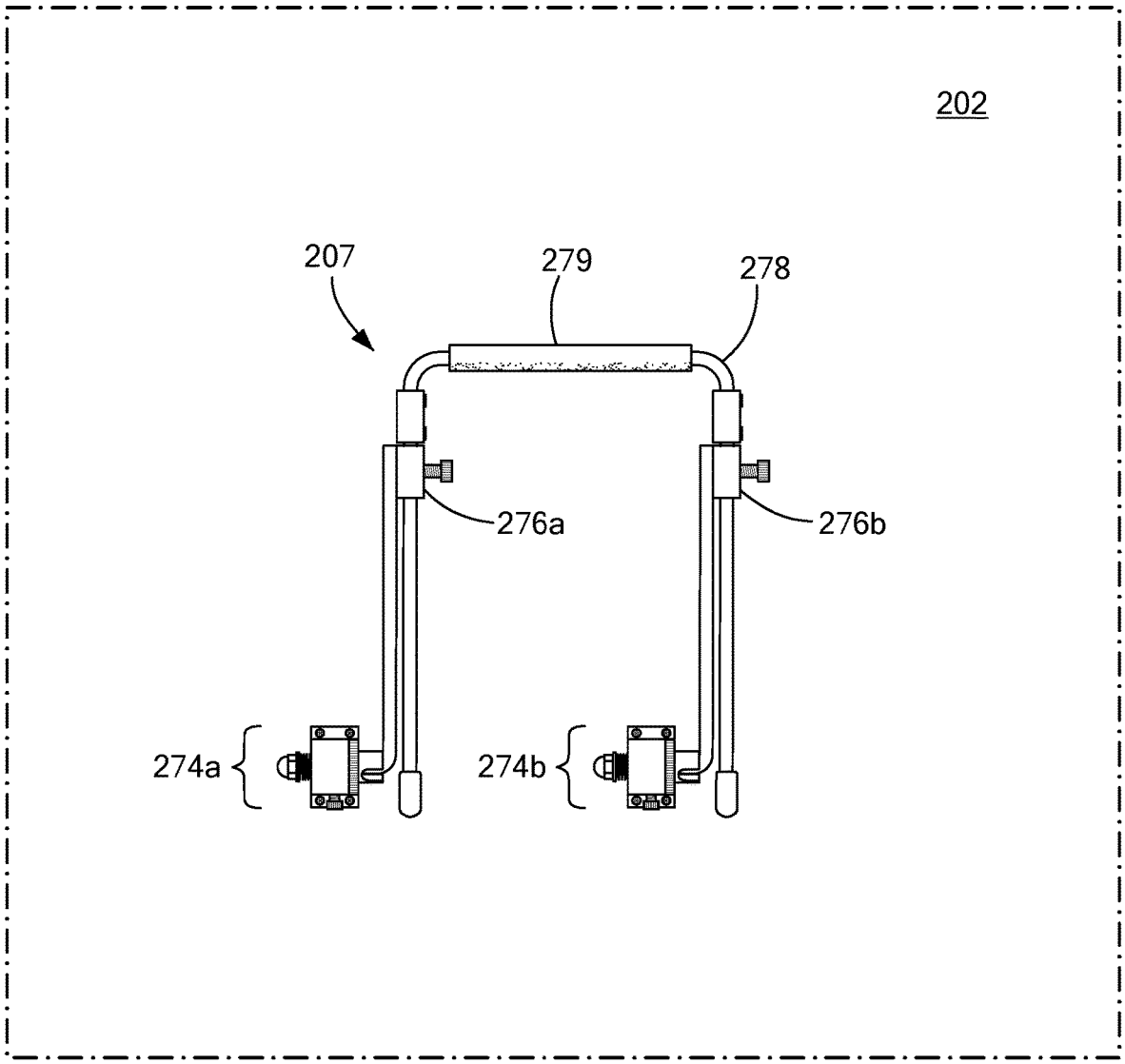
FIG. 5 is a front view of a load-bearing extendable double support in accordance with a fourth embodiment, in an unlocked, non-extended configuration.

In FIG. 5 is shown an extendable double support 270 attached to an object 202. The extendable double support 270 embodiment combines the double support structures and functions shown in FIG. 2 (i.e. double head portions 274*a* and 274*b*) with sleeves 276*a* and 276*b* for use with a double-arm, single-piece trestle 278. The trestle 278 includes a no-slip sheath 279 for illustrative purposes. As the trestle 278 forms a single assembly and is mechanically linked to both head portions 274*a* and 274*b*, the tensioning device of each head portion retains the bent portions of the head shafts against their respective bushings, thereby doubling the retaining forces.

Figure 6B:
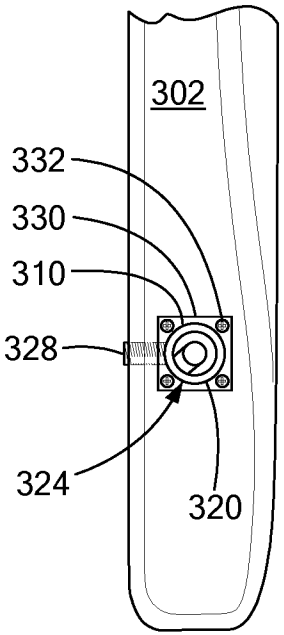
FIG. 6B is a side view of the head of the load-bearing support of the fifth embodiment.
Figure 6A:
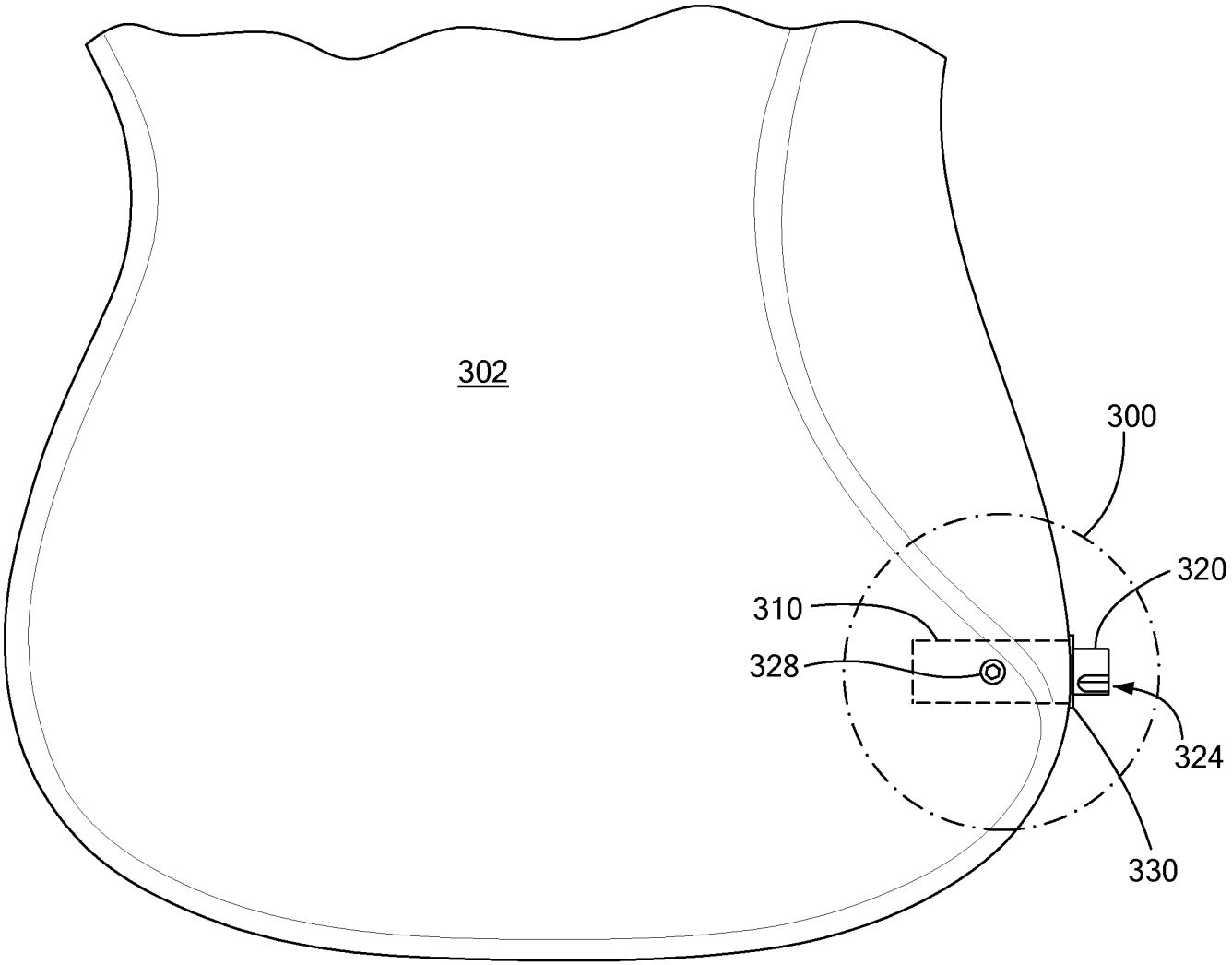
FIG. 6A is a front view of the head of a load-bearing support in accordance with a fifth embodiment.

In FIGS. 6A and 6B (collectively "FIG. 6") is shown the head 300 of another support in accordance with embodiments. The undercarriage of the support and other details of the head described above (including the tensioning device) are omitted for clarity. The head 300 is partially embedded within, rather than mounted on a surface of, the object 302 that is supported, which may be a guitar 102, loudspeaker enclosure 202, or other object. The head 300 includes a sleeve 310 with a bore, in which is retained a bushing 320 having a notch 324 on a protrusion, as described above. To permit a person to change the angle of the notch 324, and thereby change the angle by which the undercarriage (not shown) supports the object 302, a screw 328 (e.g. a set screw) is provided, for use in a manner analogous to the screw 126 of FIG. 1.

It is appreciated that in some embodiments, the both the sleeve 310 and the screw 328 already may be sufficient to mechanically hold the head 300 firmly in place within the body of the object 302. However, in FIG. 6 is shown an optional mounting plate or flange 330 having one or more mounting screws 332 for holding the head 300 in place. It is appreciated that, while FIG. 6 shows a flange 330 for holding the head 300 in place, other structures may be used for this purpose, and that while FIG. 6 shows four mounting screws 332, a greater or lesser number of screws may be used, or another type of mechanical restraint for rigidly fixing the mounting flange 330 to the object 302.

In the foregoing detailed description, various features of the embodiments are grouped together for the purpose of streamlining the disclosure. This method of disclosure is not to be interpreted as reflecting an intention that the claims requires more features than are expressly recited. Rather, inventive aspects may lie in less than all features of each disclosed embodiment.

Having described implementations which serve to illustrate various concepts, structures, and techniques which are the subject of this disclosure, it will now become apparent to those of ordinary skill in the art that other implementations incorporating these concepts, structures, and techniques may be used. Accordingly, it is submitted that that scope of the patent should not be limited to the described implementations but rather should be limited only by the spirit and scope of the following claims.

What is claimed is:

1. A load-bearing support for an object, the support comprising:

a sleeve having a bore;

a bushing, protruding from the bore and having a notch;

a shaft having a first portion and a second portion coupled by a bent portion, the first portion rotatably retained within the bushing and the second portion not retained within the bushing; and a tensioning device for pulling the bent portion of the shaft against the bushing, wherein in a locked configuration the tensioning device retains the bent portion of the shaft within the notch thereby preventing rotation of the shaft, and in an unlocked configuration the tensioning device does not retain the bent portion of the shaft within the notch thereby allowing rotation of the shaft.

2. The support according to claim 1, wherein the object is a guitar, another musical instrument, an amplifier, or a loudspeaker enclosure.

3. The support according to claim 1, wherein the second portion of the shaft comprises an undercarriage having a stabilizing arm for contacting the ground and a strut for bearing a weight of the object, the strut perpendicular to the stabilizing arm.

4. The support according to claim 1, wherein an angle between the notch and a fixed point on the sleeve is adjustable by rotating the bushing within the bore.

5. The support according to claim 4, wherein the sleeve includes a threaded hole, and the bushing is secured against movement within the bore by a retaining screw disposed within the threaded hole.

6. The support according to claim 4, wherein an exterior surface of the sleeve includes a visible marking by which to measure the angle between the notch and the fixed point.

7. The support according to claim 4, wherein a surface of the bushing includes a visible marking by which to measure the angle between the notch and the fixed point.

8. The support according to claim 1, wherein the tensioning device includes:

a mechanical stop that prevents removal of the first portion of the shaft from the bushing; and a spring disposed between, and pressing against, the mechanical stop and an end of the sleeve.

9. The support according to claim 8, wherein an end of the first portion of the shaft opposite the bent portion of the shaft is threaded, and the mechanical stop is a threaded nut.

10. The support according to claim 8, further comprising a washer, on the first portion of the shaft, disposed between the mechanical stop and the spring.

11. The support according to claim 1, wherein the sleeve comprises a gudgeon having a gudgeon plate for attaching the sleeve to a surface of the object.

12. The support according to claim 11, wherein the gudgeon plate has a surface that is shaped to register with the surface of the object.

13. The support according to claim 1, further comprising a mounting plate for attaching the support to a surface of the object, wherein the sleeve comprises a gudgeon having a gudgeon plate, and the gudgeon plate is rigidly attached to the mounting plate.

14. The support according to claim 1, further comprising:

a second sleeve with a second bore and a second retaining screw; and a second shaft for supporting a weight of the object.

15. The support according to claim 14, wherein the second shaft has a first portion and a second portion coupled by a second bent portion.

16. The support according to claim 15, wherein the first portion of the second shaft is retained within the second bore by the second retaining screw.

17. The support according to claim 15, further comprising an extension rod having a third sleeve with a third bore and a third retaining screw, wherein an end of the extension rod is retained within the second bore by the second retaining screw and the first portion of the second shaft is retained within the third bore by the third retaining screw.

18. The support according to claim 1, further comprising:

a second sleeve having a second bore;

a second bushing, protruding from the second bore and having a second notch;

a second shaft having a first portion and a second portion coupled by a second bent portion, the first portion rotatably retained within the second bushing and the second portion not retained within the second bushing;

wherein an angle between the notch and a fixed point on the sleeve equals an angle between the second notch and a fixed point on the second sleeve.

19. The support according to claim 18, wherein the shaft and the second shaft are integrally formed, and the tensioning device pulls the second bent portion of the second shaft against the second bushing.

20. The support according to claim 18, further comprising a second tensioning device for pulling the second bent portion of the second shaft against the second bushing.

* * * * *